US010874148B2

(12) United States Patent
Keen et al.

(10) Patent No.: US 10,874,148 B2
(45) Date of Patent: Dec. 29, 2020

(54) METHOD OF INSERTING A REMOVABLE INSULATOR INTO AN E-VAPING DEVICE

(71) Applicant: Altria Client Services LLC, Richmond, VA (US)

(72) Inventors: Jarrett Keen, Richmond, VA (US); Christopher S. Tucker, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 16/207,748

(22) Filed: Dec. 3, 2018

(65) Prior Publication Data

US 2019/0098937 A1 Apr. 4, 2019

Related U.S. Application Data

(60) Division of application No. 15/894,238, filed on Feb. 12, 2018, now Pat. No. 10,143,240, which is a continuation of application No. 14/926,772, filed on Oct. 29, 2015, now Pat. No. 9,913,495.

(60) Provisional application No. 62/072,101, filed on Oct. 29, 2014.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |
| ***A24F 40/95*** | (2020.01) |

(52) U.S. Cl.

CPC ..... *A24F 47/008* (2013.01); *A24F 40/95* (2020.01); *A24F 47/00* (2013.01)

(58) Field of Classification Search

CPC ..... A24F 47/008; A24F 47/002; A24F 40/40; A24F 40/70; A24F 40/95

USPC ..... 131/328, 329

See application file for complete search history.

(56) References Cited

U.S. PATENT DOCUMENTS 4,551,028 A * 11/1985 Rowen ..... G04G 19/12 368/204
6,377,848 B1 * 4/2002 Garde ..... A61M 31/002 604/20
6,601,776 B1 8/2003 Oljaca et al.
6,667,936 B1 * 12/2003 Ditzig ..... A61J 7/0409 368/10

(Continued)

FOREIGN PATENT DOCUMENTS

EP 2079063 A1 7/2009

OTHER PUBLICATIONS

International Search Report and Written Opinion from corresponding international application PCT/US2015/058031, dated Jun. 30, 2016.

(Continued)

*Primary Examiner* — Hae Moon Hyeon

(74) *Attorney, Agent, or Firm* — Harness, Dickey & Pierce, P.L.C.

(57) ABSTRACT

The method includes configuring a power supply to send an electrical current to a heater in an e-vaping device, the power supply and the heater being in an electrical circuit. The method further includes inserting a removable insulator between electrical elements to disrupt the electrical circuit, the electrical elements being both electrically conductive and electrically passive elements that are in the electrical circuit.

14 Claims, 2 Drawing Sheets

(56) References Cited

U.S. PATENT DOCUMENTS 8,262,245 B1* 9/2012 Richmond ..... F21S 9/035 362/152
8,511,318 B2 8/2013 Hon
9,423,152 B2 8/2016 Ampolini et al.
9,913,495 B2 3/2018 Keen et al.
2006/0091853 A1 5/2006 Briggs et al.
2006/0203474 A1* 9/2006 Palmer ..... A01G 5/00 362/157
2009/0027213 A1* 1/2009 Debord ..... G01K 3/005 340/588
2012/0230659 A1* 9/2012 Goodman ..... F22B 1/282 392/395
2013/0081642 A1 4/2013 Safari
2013/0213419 A1* 8/2013 Tucker ..... A24F 47/008 131/328
2013/0255702 A1 10/2013 Griffith, Jr. et al.
2014/0000638 A1 1/2014 Sebastian et al.
2014/0041658 A1* 2/2014 Goodman ..... F22B 1/282 128/203.14
2014/0150810 A1 6/2014 Hon
2014/0168960 A1* 6/2014 Halliburton ..... A63H 27/10 362/189
2014/0270727 A1 9/2014 Ampolini et al.
2015/0208731 A1* 7/2015 Malamud ..... H05B 1/0244 131/328
2016/0120223 A1* 5/2016 Keen ..... A24F 47/00
2016/0270447 A1 9/2016 Borkovec
2016/0286857 A1 10/2016 Liu
2016/0331030 A1 11/2016 Ampolini et al.
2017/0064997 A1 3/2017 Murison et al.

OTHER PUBLICATIONS

International Search Report and Written Opinion from corresponding international application PCT/US2015/058031, dated May 11, 2017.

* cited by examiner

METHOD OF INSERTING A REMOVABLE INSULATOR INTO AN E-VAPING DEVICE

PRIORITY STATEMENT

This application is a divisional of U.S. application Ser. No. 15/894,238, filed Feb. 12, 2018, which is a continuation of U.S. application Ser. No. 14/926,772, filed on Oct. 29, 2015, which claims priority to U.S. Provisional App. No. 62/072,101, filed on Oct. 29, 2014, the entire contents of each of which is incorporated by reference in their entirety.

BACKGROUND OF THE INVENTION

Field of the Invention

Example embodiments relate generally to a method of inserting a removable insulator into an electronic vaping (or, e-vaping) device.

Related Art

E-vaping devices may be used by adult vapers as a portable means of vaping. The e-vaping device may be capable of delivering a pre-vapor formulation from a supply reservoir to a heater. Specifically, e-vaping devices may include a heater capable of vaporizing a pre-vapor formulation to produce a vapor that may be inhaled by the adult vaper. E-vaping devices may also include a sensor and control circuitry for powering the heater. A power supply within the e-vaping device, or within a section of the e-vaping device, may be used to provide an electrical current to the sensor, the control circuitry and the heater in order to operate the device. During manufacturing and shipping, the power supply may be activated, thereby reducing an overall life of the power supply.

SUMMARY OF THE INVENTION

At least one example embodiment is directed toward a section of an e-vaping device.

In one embodiment, the section includes a power supply configured to send an electrical current to a heater in the e-vaping device; control circuitry configured to cause the power supply to send the electrical current to the heater if the control circuitry senses an air flow; and a removable insulator configured to disrupt an electrical circuit including the power supply, the heater and the control circuitry, a portion of the removable insulator being positioned between electrically conductive and passive components in the electrical circuit.

In one embodiment, the removable insulator is slideably removable from the section in order to allow the electrical circuit to be completed.

In one embodiment, the removable insulator is made from a non-electrically conductive material.

In one embodiment, the section further includes a housing; a ground terminal on the control circuitry; and a ground wire electrically connected to the ground terminal, a distal end of the removable insulator being positioned between the ground wire and the housing, the housing forming part of the electrical circuit.

In one embodiment, a proximal end of the removable insulator is positioned to extend from the housing.

In one embodiment, the ground wire is biased to press the ground wire toward the housing.

In one embodiment, the section further includes a gasket holding the control circuitry, the ground wire being positioned between an outer surface of the gasket and an inner surface of the housing, the distal end of the removable insulator being positioned between the outer surface of the gasket and an inner surface of the housing.

At least another example embodiment is directed toward an e-vaping device.

In one embodiment, the e-vaping device includes a first section including, a power supply configured to send an electrical current to a heater in the e-vaping device, control circuitry configured to cause the power supply to send the electrical current to the heater if the control circuitry senses an air flow, and a removable insulator configured to disrupt an electrical circuit including the power supply, the heater and the control circuitry, a portion of the removable insulator being positioned between electrically conductive and passive components in the electrical circuit.

In one embodiment, the e-vaping device further includes a second section including, a reservoir configured to contain a pre-vapor formulation, a wick configured to draw the pre-vapor formulation from the reservoir to the heater, the heater being configured to heat the pre-vapor formulation to form a vapor if the power supply sends the electrical current to the heater, and electrical leads electrically connecting the heater to the power supply and the control circuitry, the electrical leads forming part of the electrical circuit.

In one embodiment, the removable insulator is slideably removable from the first section in order to allow the electrical circuit to be completed.

In one embodiment, the removable insulator is made from a non-electrically conductive material.

In one embodiment, the first section further includes a first housing, a ground terminal on the control circuitry, and a ground wire electrically connected to the ground terminal, a distal end of the removable insulator being positioned between the ground wire the first housing, the first housing forming part of the electrical circuit.

In one embodiment, the ground wire is biased to press the ground wire toward the first housing.

In one embodiment, the first section further includes a gasket holding the control circuitry, the ground wire being positioned between an outer surface of the gasket and an inner surface of the first housing, the distal end of the removable insulator being positioned between the outer surface of the gasket and an inner surface of the first housing.

At least another example embodiment includes a section of an e-vaping device.

In one embodiment, the section includes a power supply; control circuitry configured to control access to the power supply if the control circuitry senses an air flow; and a removable insulator configured to disrupt an electrical circuit including the power supply and the control circuitry, a portion of the removable insulator being positioned between electrically conductive and passive components in the electrical circuit.

In one embodiment, the removable insulator is slideably removable from the section in order to allow the electrical circuit to be completed.

In one embodiment, the removable insulator is made from a non-electrically conductive material.

In one embodiment, the section further includes a housing; a ground terminal on the control circuitry; and a ground wire electrically connected to the ground terminal, a distal end of the removable insulator being positioned between the ground wire and the housing, the housing forming part of the electrical circuit.

In one embodiment, the ground wire is biased to press the ground wire toward the housing.

In one embodiment, the section further includes a gasket holding the control circuitry, the ground wire being positioned between an outer surface of the gasket and an inner surface of the housing, the distal end of the removable insulator being positioned between the outer surface of the gasket and an inner surface of the housing.

DETAILED DESCRIPTION

Figure 1:
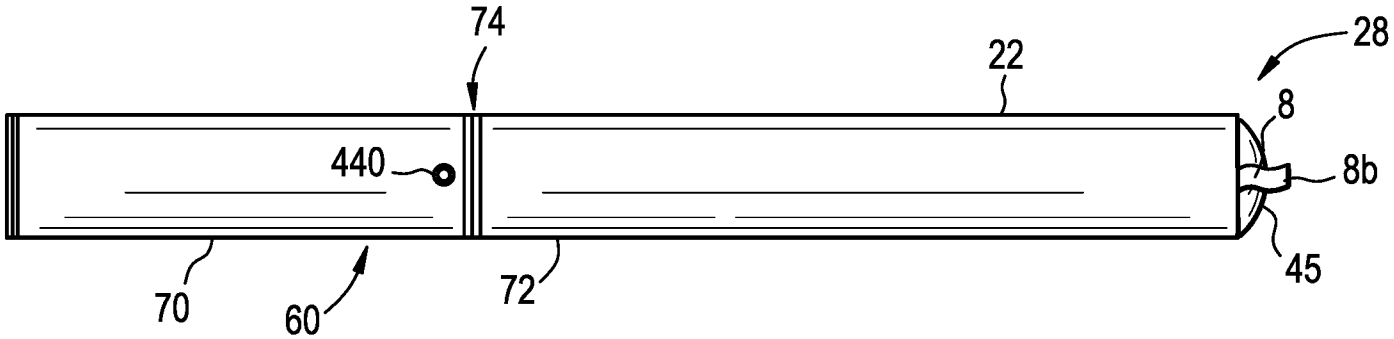
FIG. 1 is an illustration of a top planar view of an e-vaping device, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, items, regions, layers and/or sections, these elements, items, regions, layers, and/or sections should not be limited by these terms. These terms are only used to distinguish one element, item, region, layer, or section from another region, layer, or section. Thus, a first element, item, region, layer, or section discussed below could be termed a second element, item, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or items, but do not preclude the presence or addition of one or more other features, integers, steps, operations, elements, items, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

When the word "about" is used in this specification in connection with a numerical value, it is intended that the associated numerical value includes a tolerance of ±10% around the stated numerical value (or range of values). Moreover, when reference is made to percentages in this specification, it is intended that those percentages are based on weight (i.e., weight percentages). The expression "up to" includes amounts of zero to the expressed upper limit and all values therebetween. When ranges are specified, the range includes all values therebetween such as increments of 0.1%.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

FIG. 1 is an illustration of a top planar view of an e-vaping device 60, in accordance with an example embodiment. The e-vaping device 60 may generally be formed of two major sections: a first section 70 that may be a replaceable section (which may be referred to as a "cartridge" section), and a second section 72 that may be a reusable fixture containing a power supply. Optionally, both sections 70/72 may also be disposable sections. Both of the sections 70/72 may be enclosed by a housing 22. The housing 22 may be formed of any suitable material or combination of materials. The housing 22 may be cylindrical and may be formed at least partially of metal and may be part of the electrical circuit. Although the housing is described herein as cylindrical, other forms and shapes are also contemplated.

The sections 70/72 may be coupled together by a threaded joint 74, or by another mechanism such as a snug-fit connection, a snap-fit connection, a detent, a clamp and/or a clasp. Optionally, the two sections 70/72 may instead be one single section (that may be disposable), such that a joint 74 is not needed. One or more air inlets 440 may be included in the first section 70.

An insulator 8 may be positioned on an end 28 of the second section 72. Specifically, a portion of the insulator 8 may extend into the second section 72, where a midsection 8*c* of the insulator 8 may be held between the housing 22 and the end cap 45, such that a portion of a distal end 8*a* of the insulator 8 may be positioned between a control circuitry gasket 9 (where gasket 9 holds control circuitry 11) and the housing 22 to ensure that ground wire 10 may not contact housing 22 (as shown in detail in FIG. 3). A proximal end 8*b* of the insulator 8 may extend beyond the confines of the second section 72, allowing the insulator 8 to act as a "pull tab." The specific features and function of the insulator 8 is described in greater detail in relation to FIG. 3, below.

Figure 2:
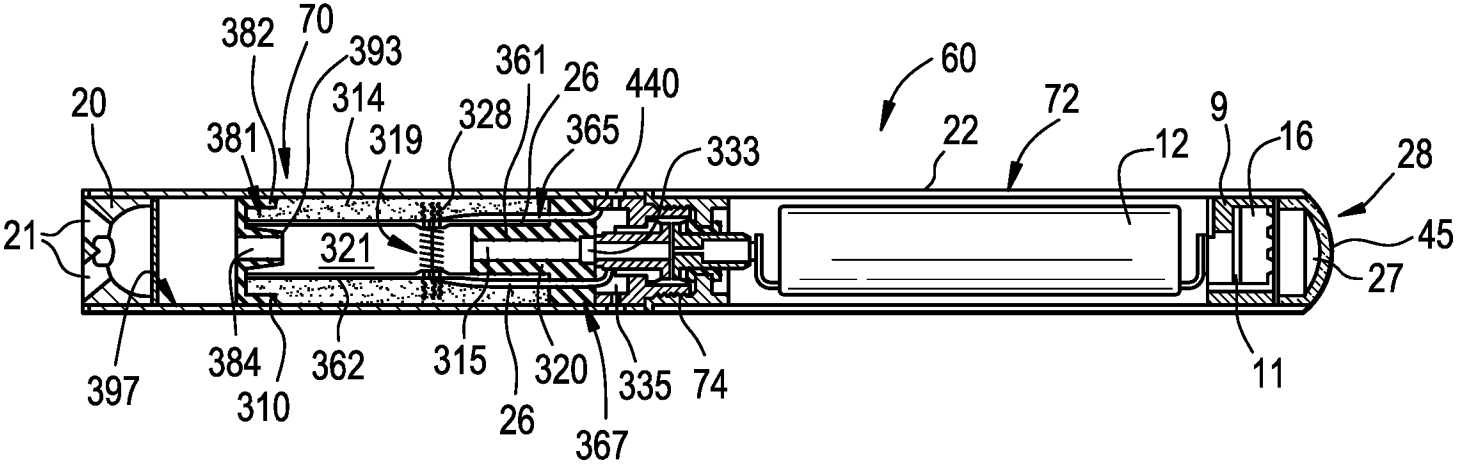
FIG. 2 is an illustration of a side cross-sectional view of an e-vaping device, in accordance with an example embodiment.

FIG. 2 is an illustration of a side cross-sectional view of the e-vaping device 60, in accordance with an example embodiment. Specifically, in this illustration, the e-vaping device 60 is shown in an operational configuration, where the insulator 8 has been removed from the device 60, allowing the e-vaping device 60 to be powered-up in order to vaporize a pre-vapor formulation.

The first section 70 may extend in a longitudinal direction with an inner tube (or chimney) 362 coaxially positioned within the housing 22. The first section 70 may include a mouth-end insert 20 at one end, with outlets 21 located at ends of off-axis passages angled outwardly in relation to a longitudinal direction of the e-vaping device 60. In an embodiment, there may be only a single centrally located outlet 21.

A nose portion 361 of a first gasket (or seal) 320 may be fitted into an end portion 365 of the inner tube 362, where an outer perimeter 367 of the first gasket 320 may provide a liquid-tight seal with an interior surface 397 of the housing 22. The first gasket 320 may also include a central, longitudinal air passage 315, which may open into an interior of the inner tube 362 to define a central channel 321. A transverse channel 333 at a portion of the first gasket 320 may intersect and communicate with the central, longitudinal air passage 315 of the first gasket 320. This channel 333 assures communication between the central, longitudinal air passage 315 and a space 335 defined between the first gasket 320 and the threaded connection 74.

A nose portion 393 of a second gasket 310 may be fitted into an end portion 381 of the inner tube 362. An outer perimeter 382 of the second gasket 310 provides a substantially liquid-tight seal with an interior surface 397 of the housing 22. The second gasket 310 may include a central channel 384 disposed between the central passage 321 of the inner tube 362 and the mouth end insert 20.

A reservoir 314 may be contained in an annulus between the inner tube 362 and the housing 22, and between the first gasket 320 and the second gasket 310. Thus, the reservoir 314 may at least partially surround the central air passage 321. The reservoir 314 may contain a pre-vapor formulation. The reservoir 314 may also optionally include a storage medium (not shown), such as a fibrous and/or gauze structure, capable of suspending the pre-vapor formulation.

The pre-vapor formulation may include a tobacco-containing material including volatile tobacco flavor compounds which may be released from the pre-vapor formulation upon heating. Alternatively, or in addition, the pre-vapor formulation may include a non-tobacco material. For example, the pre-vapor formulation may include water, solvents, active ingredients, ethanol, plant extracts and natural or artificial flavors. The pre-vapor formulation may further include a vapor former. Examples of suitable vapor formers may be glycerine, propylene glycol, etc. Because of the diversity of suitable pre-vapor formulations, it should be understood that these various pre-vapor formulations may include varying physical properties, such as varying densities, viscosities, surface tensions and vapor pressures.

A heater 319 may extend through the central air passage 321 of the inner tube 362. The heater 319 may be in contact with a filamentary wick 328, which may extend between opposing sections of the reservoir 314 so as to deliver the pre-vapor formulation from the reservoir 314 to the heater 319. Electrical leads 26 may be electrically connected to the heater 319 in order to energize the heater 319 when the device 60 is actively being used by an adult vaper. One or more air inlets 440 may be positioned near an end of the first section 70.

The second section 72 may include a power supply 12, which may be a battery that may be either disposable or rechargeable. The power supply 12 may be operable to apply a voltage across the heater 319. Thus, the heater 319 may volatilize the pre-vapor formulation according to a power cycle of either a time period, such as a 2 to 10 second period. The second section 72 may include a puff sensor 16 with control circuitry 11 which may be on a printed circuit board. The control circuitry 11 may also include a heater activation light 27 that may be operable to glow when the heater 319 is activated. The end cap 45 may be positioned on a distal end of the second section 72.

The E-Vaping Device in Use

In use, an adult vaper may draw air from the e-vaping device 60 into their mouth via the air outlets 21 of the mouth-end insert 20. This draw of air may cause air to be pulled into the device 60 via the one or more air inlets 440, where this entering air is then directed through air passage 315, central channel 321, and channel 384 before being discharged from the outlets 21. This air movement may create a vacuum force that may be sensed by puff sensor 16. In response to output from the puff sensor 16, the control circuitry 11 may cause an electrical circuit to close that includes the housing 22, the battery 12, the electrical leads 26, and the heater 319, such that the heater 319 may become electrically energized. The energized heater 319 may vaporize the pre-vapor formulation that may be drawn from reservoir 314 through wick 328 into the central channel 321. The vapor formed by the energized heater 319 may become entrained in the air flowing through the central channel 321, such that air and entrained vapor then passes through outlets 21.

Figure 3:
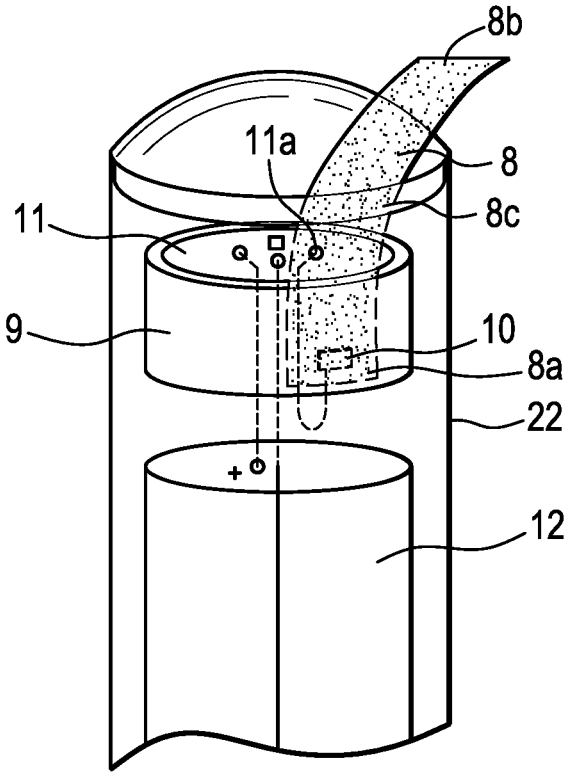
FIG. 3 is a magnified illustration of an end of a section of the e-vaping device, in accordance with an example embodiment.

FIG. 3 is a magnified illustration of an end 28 of the second section 72 of the e-vaping device 60, in accordance with an example embodiment. Specifically, FIG. 3 depicts a distal end 8*a* of the insulator 8 positioned between gasket 9 and housing 22. When the insulator 8 is fitted into the end 28 of the second section 72, the distal end 8*a* may prevent an electrical connection between the power supply 12 and the control circuitry 11, thereby preventing an activation of the e-vaping device 60 prior to an adult vaper pulling the insulator 8 from the end 28. With the distal end 8*a* of the insulator 8 positioned within the second section 72 to disrupt the electrical circuit that would otherwise be available to allow the control circuitry 11 to send electrical power to heater 319 (for instance, when the e-vaping device is in operational use by an adult vaper), the second section 72 of the e-vaping device 60 may be considered in a "stored configuration," such that the insulator 8 does not allow the control circuitry 11 to be powered on and actively operated.

In an embodiment, ground wire 10 may be electrically connected to a ground terminal 11*a* of the control circuitry 11. In operational use, the e-vaping device 60 may rely on the ground wire 10 to make contact with the housing 22 (which may be made of metal) in order to ground an electrical circuit that may energize the control circuitry 11, where this electrical circuit may also provide electrical power from the power supply 12 to the heater 319 as needed (e.g., when an adult vaper inhales from the e-vaping device, as described in detail above). To this end, the ground wire 10 may be biased to ensure that the ground wire 10 contacts and presses up against housing 22, especially following removal of the insulator 8 from end 28 prior to the e-vaping device 60 being powered on. For instance, the ground wire 10 may be biased by the gasket 9, where the gasket 9 may be made from a resilient material. The resilient material may be, for instance, silicon, nitrile rubber, or another suitable non-electrically conductive material that may effectively press the ground wire 10 in a radially outward direction, thereby ensuring that the ground wire 10 adequately contacts the housing 22 once the insulator 8 is slideably removed from second section 72. Likewise, the ground wire 10, or a portion of the ground wire 10, may be made from a resilient material that provides a spring force that ensures that the ground wire 10 adequately contacts the housing 22 once the insulator 8 is slideably removed from second section 72. Once the insulator 8 is slideably removed from the second section 72, the control circuitry 11 may be electrically powered by the power source 12, such that the second section 72 may be considered in an "activated configuration."

The insulator 8 may be formed of a non-electrically conductive, insulating material such as paper, polymers, fabrics, plastics and combinations thereof. The insulator 8 may be a small strip made from a low-friction material in order to avoid removing electrical components, or in particular removing the ground wire 10, as the insulator 8 is pulled from the end 28 prior to an activation and operational use of the device 60.

The insulator may be long enough to provide a sufficient amount of material to be grasped by an adult vaper. For instance, the insulator 8 may be about 0.1 cm to 1.0 cm in length. The insulator 8 may also be about 0.2 cm to 0.9 cm long, or about 0.3 cm to 0.8 cm long, or about 0.4 cm to 0.7 cm long, or about 0.5 cm to 0.7 cm long. The insulator 8 may also be about 0.1 cm to 1.0 cm in width. The insulator 8 may also be about 0.2 cm to 0.9 cm wide, or about 0.3 cm to 0.8 cm wide, or about 0.4 cm to 0.7 cm wide, or about 0.5 cm to 0.6 cm wide.

The proximal end 8*b* of the insulator 8 (if not the entirety of insulator 8) may be textured to allow an adult vaper to more easily grasp the end 8*b* and remove the insulator 8 from the end 28 of the e-vaping device 60. The insulator 8 may be any color, and may include indicia, such as instructions for removal and/or trademark information. The material used to form the insulator 8 may be strong enough to withstand a force needed to pull the insulator 8 and fully remove the insulator 8 from between the housing 22 and the gasket 9 in order to activate the e-vaping device 60.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A method of inserting a removable insulator into an e-vaping device, comprising:

configuring a power supply to send an electrical current to a heater in the e-vaping device, the power supply, the heater and electrical elements being in an electrical circuit;

inserting the removable insulator between the electrical elements to disrupt the electrical circuit, the removable insulator being inserted to directly contact the electrical elements, the electrical elements being both electrically conductive and electrically passive elements;

connecting a ground wire to the electrical circuit; and configuring the e-vaping device to simultaneously cause the ground wire to contact a grounding terminal, and the electrical circuit to be completed, upon removal of the removable insulator from the e-vaping device.

2. The method of claim 1, wherein the inserting includes:

configuring the removable insulator to be slideably removable from the e-vaping device.

3. The method of claim 1, wherein the removable insulator includes non-electrically conductive material.

4. The method of claim 1, further comprising:

configuring a control circuitry to cause the power supply to send the electrical current to the heater if the control circuitry senses an airflow in the e-vaping device.

5. The method of claim 1, wherein the inserting further includes:

inserting the removable insulator between the ground wire and a housing of the e-vaping device, the ground wire and the housing being the electrical elements.

6. The method of claim 5, wherein the configuring further includes:

biasing the ground wire to be pressed toward the housing using a resilient material.

7. The method of claim 5, wherein the inserting further includes:

inserting the removable insulator so that an end of the removable insulator extends from the e-vaping device at a location that is between an end cap and a housing of the e-vaping device.

8. The method of claim 1, wherein the electrical elements include a first electrical element and a second electrical element, and the inserting includes inserting the removable insulator between the first electrical element and the second electrical element, and wherein the method further comprises biasing the first electrical element to be pressed toward the second electrical element using a resilient material.

9. The method of claim 8, wherein the inserting further includes:

inserting the removable insulator so that an end of the removable insulator extends from the e-vaping device at a location that is between an end cap and a housing of the e-vaping device.

10. The method of claim 1, wherein the inserting further includes:

inserting only a portion of the removable insulator in the e-vaping device, with a remaining portion of the removable insulator remaining outside of the e-vaping device, the remaining portion being configured to be pulled to cause the removable insulator to be removed from the e-vaping device.

11. The method of claim 1, wherein the inserting further includes:

inserting the removable insulator so that an end of the removable insulator extends from the e-vaping device at a location that is between an end cap and a housing of the e-vaping device.

12. The method of claim 1, wherein the grounding terminal is a housing of the e-vaping device.

13. The method of claim 1, wherein the configuring further includes:

biasing the ground wire against the grounding terminal.

14. The method of claim 13, wherein the grounding terminal is a housing of the e-vaping device.

* * * * *